US006239504B1

(12) United States Patent
Gobrecht et al.

(10) Patent No.: US 6,239,504 B1
(45) Date of Patent: May 29, 2001

(54) TURBINE GUIDE AND A METHOD FOR REGULATING A LOAD CYCLE PROCESS OF A TURBINE

(75) Inventors: Edwin Gobrecht, Ratingen; Rolf Langbein, Bochum, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/307,997

(22) Filed: May 10, 1999

Related U.S. Application Data

(63) Continuation of application No. PCT/DE97/02607, filed on Nov. 7, 1997.

(30) Foreign Application Priority Data

Nov. 7, 1996 (DE) ..... 97/02607

(51) Int. Cl.[7] ..... F01D 15/10; H02K 7/18

(52) U.S. Cl. ..... 290/52; 290/2; 290/4 R; 290/40 R; 290/40 A

(58) Field of Search ..... 290/2, 4 R, 52, 290/54, 4 C; 364/552, 554; 60/646, 657

(56) References Cited

U.S. PATENT DOCUMENTS

| | | | | |
|---|---|---|---|---|
| 4,121,424 | | 10/1978 | Sato et al. | 60/646 |
| 4,228,358 | | 10/1980 | Matsumoto et al. | 60/646 |
| 4,320,625 | * | 3/1982 | Westphal et al. | 60/646 |
| 4,575,803 | | 3/1986 | Moore | 60/646 |
| 4,598,551 | * | 7/1986 | Dimitroff, Jr. et al. | 60/646 |
| 5,042,246 | * | 8/1991 | Moore et al. | 60/39.03 |
| 5,517,424 | * | 5/1996 | Marcelle et al. | 364/494 |
| 5,748,500 | * | 5/1998 | Quentin et al. | 364/551 |

FOREIGN PATENT DOCUMENTS

| | | |
|---|---|---|
| 390 947 | 8/1965 | (CH) . |
| 14 26 262 | 4/1969 | (DE) . |
| 26 05 689 A1 | 8/1977 | (DE) . |
| 28 05 303 A1 | 8/1978 | (DE) . |

OTHER PUBLICATIONS

Patent Abstracts of Japan No. 60081406 (Yoshio), dated May 9, 1985, Turbine Controller.

Siemens–Energietechnik vol. 4 (1982), No. 2 (Gelleri et al.), "Turbinenleitrechner zur thermischen Überwachung von Dampfturbinen", pp. 103–107, Turbine control calculator for thermally monitoring steam turbines.

BKW, vol. 36 (1984), No. 12–Dec, (Martin et al.), "Temperaturleitgerät für Kraftwerksturbinen", pp. 499–508, Temperature control system for power plant turbines.

Hitachi Review vol. 27 (1978), No. 7 (Honda et al.), Digital Computer Control System for Turbine Start–up.

* cited by examiner

*Primary Examiner*—Elvin Enad
(74) *Attorney, Agent, or Firm*—Herbert L. Lerner; Laurence A. Greenberg; Werner H. Stemer

(57) ABSTRACT

A turbine guide regulates a load cycle process in a turbine. The turbine guide has a limiting unit, to which a variable for a variable pre-setting of a time duration $t_v$ of the load cycle process can be fed. In the limiting unit, a determination of a turbine guide variable takes place for carrying out the load cycle process in the time duration $t_v$ under consideration of a maximum permissible limiting value. In an exhaustion unit an advance determination of the material exhaustion of the load cycle process to be carried out according to the turbine guide variable takes place. The invention further pertains to a method for regulating a load cycle process of a turbine.

11 Claims, 1 Drawing Sheet

TURBINE GUIDE AND A METHOD FOR REGULATING A LOAD CYCLE PROCESS OF A TURBINE

CROSS-REFERENCE TO RELATED APPLICATION

This application is a continuation of copending International Application No. PCT/DE97/02607, filed Nov. 7, 1997, which designated the United States.

BACKGROUND OF THE INVENTION

Field of the Invention

The invention pertains to a turbine guide and a method for regulating a load cycle process of a turbine, particularly a steam turbine, whereby a maximum permissible material stress due to the load cycle process is taken into account.

In the article "Digital Computer Control System for Turbine Start-Up" by N. Honda, Fn. Kavano, J. Matsumura in Hitachi Review, Vol. 27, No. 7, 1978, a computer system as well as a method for carrying out an accelerated start-up of a steam turbine is described. The start-up process is regulated here by thermal stresses as controlled variables, which are precalculated and serve as control variables for increasing a turbine rotation speed and a coupling of the turbine on to a generator for load transmission. The start-up process is divided into many small times stages, whereby for each time stage the temperature division is solved along the turbine shaft by solving a partial differential equation. If the thermal stresses calculated therefrom lie within a permissible framework, then a corresponding signal is transmitted on to a turbine speed regulating unit or a power regulating unit, depending on whether the turbine is in an acceleration phase in which the rotation speed of the shaft is being increased, or whether the turbine is in a power coupling phase in which the turbine is connected on to the generator and brought up to the desired power capacity. The method as well as the corresponding computer system serve the purpose of achieving the shortest possible start-up time, taking into consideration the permissible material stresses for a certain starting frequency.

In the article "Temperature Guide For Power Plant Turbines" by P. Martin et al. in BWK, Vol. 36, No. 12, 1984, a mechanism is described by which the monitoring of the stress of selected turbine parts takes place. With this mechanism a regulation of each starting sequence takes place, so that the material fatigue over the expected operation period of the turbine remains below a critical value. It is however assumed that a turbine during its period of application goes through about 4000 start-up sequences, out of which about 3000 are hot starts, 700 are warm starts and 300 are cold starts. For the regulation, the target capacity as well as the rated power capacity transient are pre-given. Taking into consideration the measured rotation speed, the heat transfers of steam on to the rotor material are determined. From that the temperature distribution on the rotor is determined and from that again a stress value as a superimposition of thermal and mechanical stresses can be determined. From the total stress within the rotor as well as the valve housing, percentages of the degree of fatigue are calculated from the time position stress and expansion cycle stress and then added up to the total fatigue degree, which is recorded daily. The calculated stress values serve the purpose of controlling the set-up process, whereby the rated temperature transients are pre-given as limiting values.

In the article "Turbine Guide Calculators For Thermal Monitoring Of Steam Turbines" by E. Geller and F. Zermayr in Siemens-Energietechnik 4, issue 2, 1982, a turbine guide calculator is described, in which the start-up speed and the power variation speed is controlled under consideration of the material fatigue and simultaneously the material fatigue caused is determined. As a measurement for heat stress one takes the difference between an average temperature $T_m$ and the surface temperature $T_1$, of a component. For adapting the regulation to different start-up and take-off sequences and for power variations of fixed-pressure operated turbines, three different regulating modes are foreseen, which correspond to a fast, a medium and a slow variation. Depending on the mode, a maximum permissible temperature difference ($T_m$, $T_1$) is pre-given as a function of the average temperature $T_m$. The actual temperature difference in each case is determined by the turbine guide calculator and from that the free amount for maximum permissible temperature difference is calculated. Apart from the calculation of the momentary free amount, a preview of the expected course of the free amount is also carried out. From both of these values a guiding value is formed with the help of which the start-up and stress speed can be changed in advance by the rated value guide for the speed and capacity, and thus an adaptation to the dynamic plant behavior can be achieved. Along with the operation for regulating the start-up or starting sequence as well as a power variation sequence, the life-span consumption from expansion cycle fatigue is calculated, so that one can determine in a timely manner and beforehand, when the time point would be reached at which a precise inspection of the turbine would become necessary. The start-up mode "normal" corresponds exactly to a start-up mode by which 4000 load cycles of the turbine are possible in a safe manner. The start-up mode "fast" leads to a higher stress corresponding to about 800 possible load cycles and the start-up mode "slow" leads to a lower material fatigue, so that in this case about 10000 load cycles are possible safely.

SUMMARY OF THE INVENTION

It is accordingly an object of the invention to provide a turbine guide and a method for regulating a load cycle process of a turbine which overcome the above-mentioned disadvantages of the prior art devices and methods of this general type, by which one can achieve a flexible variation in the operating condition of the turbine conforming to the operational specifications for generating electrical energy, taking into account the maximum permissible material fatigue. It is also the task of the invention to present a suitable method for regulating a load cycle process of a turbine.

With the foregoing and other objects in view there is provided, in accordance with the invention, a turbine guide for regulating a load cycle process of a turbine, including: a limiting unit receiving a variable for a variable presetting of a time duration $T_v$ of a load cycle process of a turbine, the limiting unit determining a turbine guide variable for carrying out the load cycle process in the time duration $T_v$ in consideration of a maximum permissible material stress of the turbine.

The advantage of a turbine guide as per the invention is the indirect or direct pre-giving of the desired time for start-up and starting and the power variation of the turbo set under consideration of physical limiting values.

For feeding a time variable, an input unit/selection unit can be foreseen. To this one can feed a variable pre-given value of the time duration for the load cycle process, this variable can already be the time duration itself. For carrying out the load cycle process, preferably a flexible pre-settable time duration is determined individually for each load cycle process. The time duration can be freely selected, i.e. it can accept any physically meaningful values. It can be set in a stageless manner for each physical and operationally meaningful value. Thus, from the point of view of the operator, depending on the requirement, especially with respect to the required supply of electrical energy, the duration for a load cycle from an initial condition to a target condition can be pre-given. For regulation of the load cycle process, which could be a start-up or starting process as well as a power variation process, a turbine guide variable is determined in the limiting unit by pre-giving the time duration; this variable is determined as a function of the time in the time duration between leaving the initial condition and reaching the target condition. Besides the pre-selected time duration (start-up time, starting time, load variation time), the turbine guide variable is also dependent on the initial temperature at the point of time of the initial condition and the final temperature at the point of time of the target condition, the geometry of the components, the material used, the steam condition and the temperature level. With the determination of the turbine guide variable, in the case of a start-up, a fixing of the step-up criteria for stepping up the speed from the warming up rotation to the nominal rotation speed takes place, as well as the subsequent synchronization of the minimum power consumption. For this, the turbine parameters like turbine rotation speed, steam pressure, temperature and power capacity are varied over the turbine guide variable with the help of a rated value function (regulated, controlled).

The turbine guide preferably has an exhaustion unit, in which the determination of the material exhaustion of the load cycle process to be carried out according to the turbine guide variable takes place. The exhaustion unit can calculate the additional material exhaustion beforehand, so that on the basis of this material exhaustion and the still desired operation duration of the turbine, it can be decided either manually or automatically whether the load cycle process should actually be carried out in the desired duration. For this, the expected material fatigue is depicted preferably with the help of an output medium, e.g. a monitor, a printer etc. The exhaustion unit also serves the purpose of determining the material exhaustion if the load cycle process has been actually carried out in the desired time duration. The values of the additional material exhaustion can similarly be stored with the help of a suitable output medium as well as in a storage medium, especially a storage medium of a computer system. Thus, at any point of time, information is available about the exhaustion of the material, and hence about the remaining operation duration. In this way, future load cycle processes can also be carried out with an appropriately flexible preselectable time duration, whereby for already high material exhaustion a material-protecting operation of the load cycle (longer time duration) or in case of sufficiently large reserve (low material exhaustion) a faster load cycle operation (short time duration) is possible.

The turbine guide has a regulating unit and/or a control unit, which can be connected to a controlling element of the turbine for regulating and/or controlling a load cycle process. In the case of a steam turbine, the control member is preferably a valve through which the inflow of hot steam can be regulated. For determining the actual stress, the turbine guide has a stress unit, to which system values like pressure values and temperature values can be fed. The stress unit is connected with the exhaustion unit and/or the limiting unit. The system values processed or forwarded in the stress unit are fed to the limiting unit, so that one can carry out a comparison between the rated value and the actual value of the turbine guide variable, and in case of a corresponding fluctuation, a regulating intervention can be carried out, i.e. activating the control member. On the basis of the system values, the determination of additional material exhaustion takes place in the exhaustion unit, which, as already mentioned, can be saved or displayed. The turbine guide variable preferably represents a measure for the material fatigue. The material fatigue is kept by and large constant during the load cycle process. The temperature guide variable could be the temperature difference between an average component temperature and a surface component temperature, especially the turbine shaft or the turbine housing, as described in the above-mentioned article "Turbine Guide Calculator For Thermal Monitoring Of Steam Turbines". By pre-giving a limiting value for a turbine guide variable it is ensured that, on the one hand, the material stress during the load cycle process remains below a critical limit, and, on the other hand, temperature expansions remain in a required framework, so that one can avoid bridging of a clearance between two components of the turbine or bending.

In the stress unit, preferably system values at different points of the turbine as well as the different components (turbine shaft, valves, boiler etc. ) are determined. In this way, for different components of the turbine the percentages of fatigue occurring can be determined separately in the exhaustion unit, and from that a total exhaustion of the turbine or individual components can be determined and stored.

It is obvious that the turbine guide can be in the form of a total unit or individual units as computer programs, as an electronic component or as a circuit on a microprocessor.

Other features which are considered as characteristic for the invention are set forth in the appended claims.

Although the invention is illustrated and described herein as embodied in a turbine guide and a method for regulating a load cycle process of a turbine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
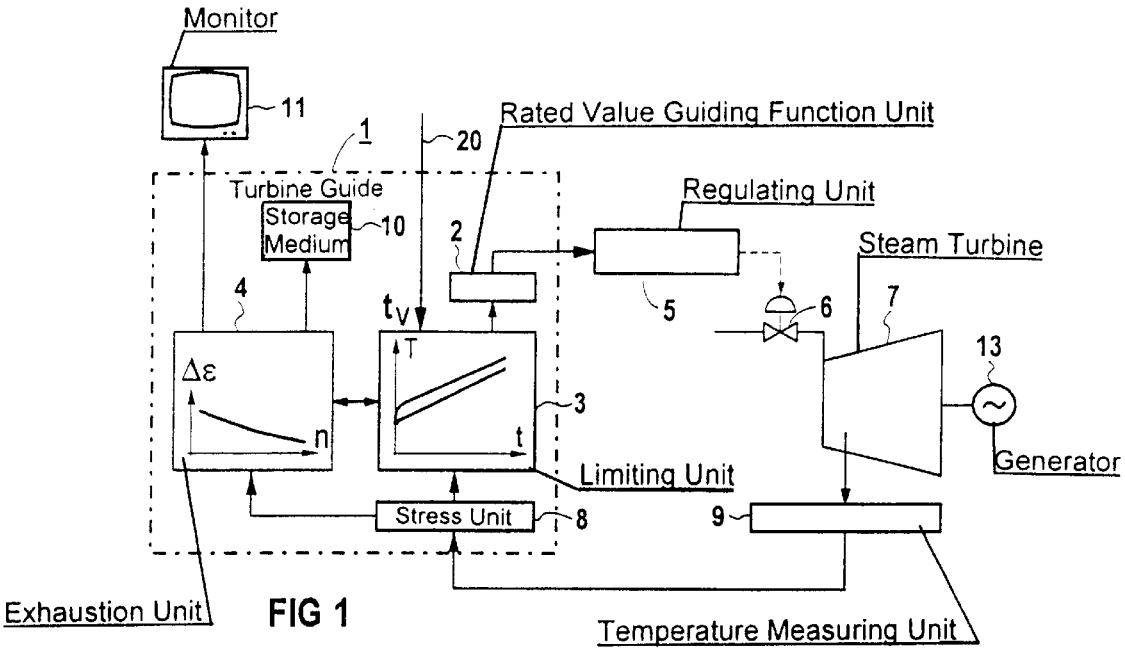
FIG. 1 is a diagrammatic, block diagram of a steam turbine with a turbine guide according to the invention.
Figure 2:
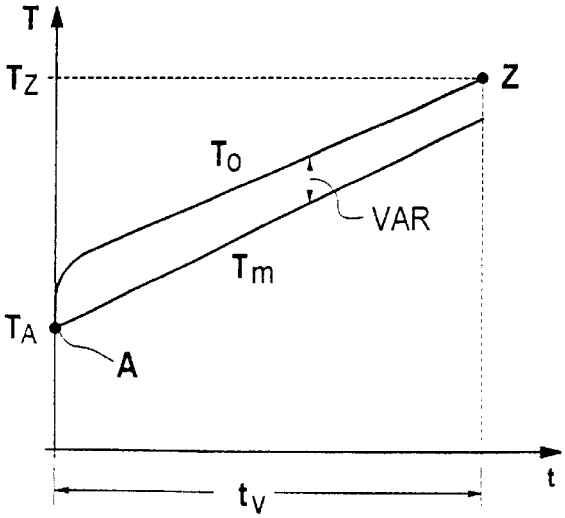
FIG. 2 is a graph of a temperature on a turbine shaft during a time duration of a load cycle process.

In all the figures of the drawing, sub-features and integral parts that correspond to one another bear the same reference symbol in each case. Referring now to the figures of the drawings in detail and first, particularly, to FIG. 1 thereof, there is shown a steam turbine 7 with a generator 13 connected to it and with a turbine guide 1. To the turbine guide 1 one can feed a signal or a variable 20 for the desired time duration of a load cycle process (e.g. over an input unit), as indicated by the arrow 20. The signal corresponding to a time duration $t_v$ is guided to a limiting unit 3. In the limiting unit 3, taking into account data from an exhaustion unit 4 connected to the limiting unit 3, a determination of a respective turbine guide variable VAR takes place depending on the time duration $t_v$, so that a regulation of a load cycle from an initial condition A into a target condition Z can be conducted. This is shown enlarged in FIG. 2. The turbine guide variables VAR are formed for the various components to be monitored, like valve housing, turbine housing and turbine shaft and represent temperature differences of temperature $T_0$ between the respective surface and an integral average temperature $T_m$ of the respective component. Each turbine guide variable VAR represents a temperature difference between both the temperatures $T_0-T_m$ resulting in a measure for a thermo-stress or a thermal expansion and hence for a cycle stress fatigue. The turbine guide variables VAR are determined by the time duration $t_v$ in such a way that during the entire time duration $T_v$ there occurs a constant fatigue and hence a constant increase of the exhaustion. FIG. 2 shows a graph for a start-up process, in which the average temperature $T_m$ is less than the surface temperature $T_0$. For a take-off process (not shown) the average temperature $T_m$ is greater than the surface temperature $T_0$.

The limiting unit 3 is connected to the exhaustion unit 4, so that the prior determined values of the turbine guide variables VAR can be fed to the latter. In the exhaustion unit 4 an advance calculation takes place of the fatigue caused by the load cycle process. The additional fatigue is also reflected on an output medium 11, which is connected to the exhaustion unit 4. The output medium 11 could for example be a monitor that could be placed in a non-illustrated observatory tower of the power plant having the turbine 7.

The difference in value between the turbine guide variable VAR and a measured temperature difference ($T_0-T_m$) of the component is fed to a rated value guiding functional unit 2. Corresponding to this difference ($T_0-T_m$) the permissible rotation speed variation and power capacity variation is determined in the rated value guiding functional unit 2. From there comes a signal for varying the turbine rotation speed and the power capacity which is passed on to a regulating unit 5, by which a regulating member 6 of the turbine 7 is activated, especially a steam valve. Corresponding to the turbine guide variable VAR, thus the flow of steam into the turbine 7 is set, by which indirectly also regulation of the surface temperature $T_0$ and the average temperature $T_m$ takes place, especially of the turbine shaft. The system values of the turbine 7, particularly the steam temperature, the component temperature as well as the steam pressures, are determined with the help of measuring elements which are not shown, e.g. thermo-elements, and are taken up in a temperature measuring unit 9. The temperature measuring unit 9 is connected to a stress unit 8 and transmits determined system values to it. In the stress unit 8 an evaluation of the system values takes place, particularly a calculation of the surface temperature $T_0$ and the average temperature $T_m$ of the turbine shaft. These values are transmitted to the limiting unit 3 and/or to the exhaustion unit 4. In the limiting unit 3 a comparison is done between the previously determined rated value particularly in the limiting unit 3, and the actual value of the turbine guide variable VAR determined in the stress unit 8. In case of variations between the rated and actual value an appropriate regulating intervention in the regulating member 6 takes place by the rated value guided function through the regulating unit 5. In the exhaustion unit 4, from the values of the stress unit 8 the additional exhaustion, i.e. material fatigue, is determined by the actually carried out load cycle process. The exhaustion is, on the one hand, displayed on the output medium 11 and, on the other hand, if required stored with the additional system values of the turbine 7 in a storage medium 10, particularly a hard disc of a computer unit or any other data carrier.

The invention is characterized by the turbine guide that 25 works in a time-oriented manner, especially start-up time-oriented manner, whereby the time duration of a load cycle process can be regulated in a stageless manner within the framework of a maximum permissible material stress. By the possibility of regulating load cycle processes in the desired times $T_v$, load cycle processes can be time-wise adapted particularly advantageously to the supply specifications. The turbine guide additionally enables a foreseeable and at any point of time updated life duration monitoring. The already occurred fatigue of the monitored turbine components is continuously determined.

We claim:

1. A turbine guide for regulating a load cycle process of a turbine, comprising:

a limiting unit receiving a variable for a variable presetting of a time duration $T_v$ of a load cycle process of a turbine, said limiting unit determining a turbine guide variable for carrying out the load cycle process in the time duration $T_v$ in consideration of a maximum permissible material stress.

2. The turbine guide according to claim 1, including an exhaustion unit exchanging data with said limiting unit and determining in advance a material exhaustion of the load cycle process to be carried out as per the turbine guide variable.

3. The turbine guide according to claim 2, including a stress unit receiving system values including a pressure value and a temperature value of the turbine and connected to at least one of said exhaustion unit and said limiting unit.

4. The turbine guide according to claim 2, including:

a storage medium connected to said exhaustion unit; and an output medium connected to said exhaustion unit.

5. The turbine guide according to claim 1, including:

a regulating unit receiving an actual value of the turbine guide variable from said limiting unit; and a regulating member for regulating the load cycle process of the turbine and connected to said regulating unit.

6. The turbine guide according to claim 1, wherein the turbine guide variable is derived such that it is a measure of material fatigue, including a temperature difference characterizing the material fatigue, and the material fatigue remains by and large constant during the load cycle process.

7. A method for regulating a load cycle process of a turbine, which comprises:

determining a turbine guide variable that considers material parameters and a load process cycle for characterizing a material exhaustion during a time duration $t_v$ of the load cycle process; and carrying out a turbine regulation during the time duration $t_v$ by use of the turbine guide variable for transferring a turbine from an initial condition into a final condition during the time duration $T_v$.

8. The method according to claim 7, which comprises determining the turbine guide variable such that material fatigue is by and large kept constant over the time duration $T_v$.

9. The method according to claim 7, which comprises regulating at least one turbine parameter by taking into account the turbine guide variable.

10. The method according to claim 9, wherein the at least one turbine parameter is selected from the group consisting of a turbine rotation speed, a steam pressure, a temperature and a power capacity.

11. The method according to claim 7, which comprises displaying beforehand an additional material fatigue to be expected due to the load cycle process.

* * * * *